US008659628B2

(12) United States Patent
Wen et al.

(10) Patent No.: US 8,659,628 B2
(45) Date of Patent: Feb. 25, 2014

(54) METHOD FOR CONTROLLING GATE SIGNALS AND DEVICE THEREOF

(75) Inventors: Chun-Kuei Wen, Hsin-Chu (TW); Shih-Hsun Lo, Hsin-Chu (TW); Shih-Chieh Kuo, Hsin-Chu (TW); Che-Hsien Chen, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 260 days.

(21) Appl. No.: 13/114,019

(22) Filed: May 23, 2011

(65) Prior Publication Data

US 2012/0105512 A1 May 3, 2012

(30) Foreign Application Priority Data

Oct. 27, 2010 (TW) ..... 99136731 A

(51) Int. Cl.
*G09G 5/10* (2006.01)

(52) U.S. Cl.
USPC ..... 345/691; 345/78; 345/101; 345/690

(58) Field of Classification Search
USPC ..... 345/98, 101, 690, 691
See application file for complete search history.

(56) References Cited

U.S. PATENT DOCUMENTS

| | | | | |
|---|---|---|---|---|
| 5,854,662 | A * | 12/1998 | Yuyama et al. | 348/790 |
| 7,002,542 | B2 | 2/2006 | Lee | |
| 8,400,073 | B2 * | 3/2013 | Byun et al. | 315/291 |
| 2003/0164813 | A1 * | 9/2003 | Fujii | 345/101 |
| 2006/0082534 | A1 * | 4/2006 | Honda et al. | 345/98 |
| 2006/0284815 | A1 | 12/2006 | Kwon | |
| 2007/0236445 | A1 * | 10/2007 | Gong et al. | 345/102 |
| 2007/0262948 | A1 * | 11/2007 | Han et al. | 345/102 |
| 2008/0143757 | A1 * | 6/2008 | Furihata et al. | 345/690 |
| 2008/0158136 | A1 * | 7/2008 | Kaneda | 345/102 |
| 2008/0248837 | A1 * | 10/2008 | Kunkel | 455/566 |
| 2009/0079713 | A1 * | 3/2009 | Nagashima | 345/204 |
| 2009/0135128 | A1 * | 5/2009 | Jeon et al. | 345/102 |
| 2009/0137282 | A1 * | 5/2009 | Otaka | 455/566 |
| 2010/0156866 | A1 * | 6/2010 | Yeo et al. | 345/208 |
| 2011/0080397 | A1 * | 4/2011 | Yamamoto et al. | 345/214 |

FOREIGN PATENT DOCUMENTS

| | | | |
|---|---|---|---|
| CN | 1160260 | A | 9/1997 |
| EP | 0765078 | | 3/1997 |
| EP | 1895489 | | 3/2008 |
| GB | 2429823 | A | 3/2007 |
| JP | 57201389 | | 12/1982 |
| TW | 200713170 | | 4/2007 |
| WO | WO2008099930 | | 8/2008 |

* cited by examiner

*Primary Examiner* — Thuy Pardo
(74) *Attorney, Agent, or Firm* — Winston Hsu; Scott Margo

(57) ABSTRACT

A method for controlling gate signals of a liquid crystal display (LCD), including generating gate signal with a modulated pulse width according to the gate signal with a default pulse width; when the LCD is booting up, outputting the gate signal with the modulated pulse width; and when a backlight module of the LCD is turned on, switching the gate signal with the modulated pulse width to the gate signal with the default pulse width. This way, the pulse width of the gate signal is increased after the LCD is boot up and before the backlight module is turned on, enabling the LCD to be boot properly in low temperature, without the need to raise the voltage level of the gate signal.

16 Claims, 3 Drawing Sheets

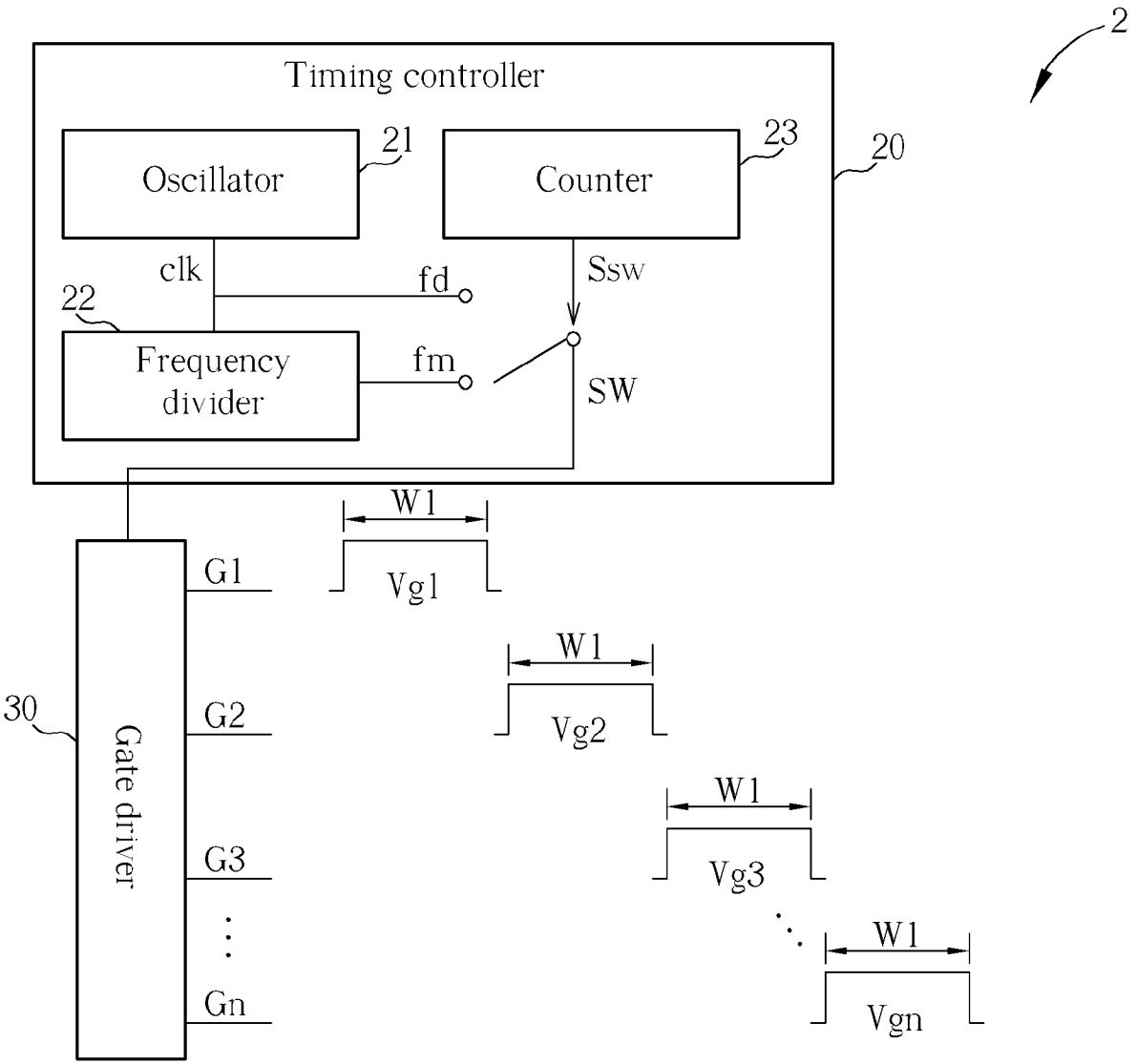
FIG. 2
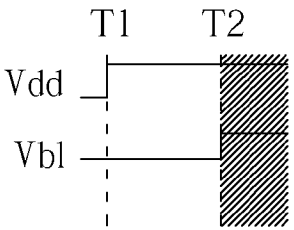

METHOD FOR CONTROLLING GATE SIGNALS AND DEVICE THEREOF

CROSS REFERENCE TO RELATED APPLICATIONS

This application claims priority of Taiwan Patent Application No. 099136731, filed Oct. 27, 2010, and included herein by reference in its entirety for all intents and purposes.

BACKGROUND OF THE INVENTION

1. Field of the Invention

The present invention is related to a method for controlling gate signals of a liquid crystal display device, and more particularly, to a method for controlling gate signals of the liquid crystal display device for reducing power consumption and allowing the liquid crystal display device to boot properly at low temperature.

2. Description of the Prior Art

A conventional thin film transistor (TFT) liquid crystal display (LCD) device comprises a gate driving circuit, a source driving circuit and a plurality of pixels. The gate driving circuit comprises a plurality of scan lines and the source driving circuit comprises a plurality of data lines. The plurality of scan lines and the plurality of data lines are interlaced, and each interlaced data line and scan line drive one pixel, so the plurality of pixels form a display matrix. Each pixel comprises a thin film transistor, wherein the gate end of the transistor is coupled to a scan line in the horizontal direction, the drain end of the transistor is coupled to a data line in the vertical direction, and the source end is coupled to a pixel electrode. The gate driving circuit outputs gate signals to the plurality of scan lines. If a sufficient driving voltage, such as a high bias voltage Vgh of the gate signal, is applied to a scan line, all of the thin film transistors corresponding to the scan line are turned on, meaning the pixel electrodes corresponding to the scan line are coupled to the corresponding data line in the vertical direction, for the display signal of the data line to be inputted to the corresponding pixel, so a color displayed by the pixel can be controlled.

Gate on array (GOA) technology allows the gate driving circuit to be integrated with the LCD panel, for reducing the manufacturing processing and cost. Currently, the TFT LCD device utilizing GOA technology is likely to encounter the issue of being unable to boot up properly at low temperature. The conventional solution is to utilize a thermal sensor to detect the temperature of the TFT LCD device during boot up. If the detected temperature is lower than a predetermined value, the TFT LCD device increases the voltage level of the gate signal (e.g. increases a voltage level of a high bias voltage Vgh of the gate signal), for enabling the thin film transistor of the pixel to be turned on normally at low temperature. However, the conventional solution requires extra peripherals such as the thermal sensor and relative components, causing higher manufacturing cost. Further, increasing the voltage level of the gate signal also consumes extra power.

SUMMARY OF THE INVENTION

The present invention discloses a method for controlling gate signals of a liquid crystal display device. The method comprises generating a gate signal with a modulated pulse width according to a gate signal with a default pulse width; outputting the gate signal with the modulated pulse width when the LCD device is turned on; and switching the gate signal with the modulated pulse width to the gate signal with the default pulse width when a backlight module of the LCD device is turned on.

The present invention further discloses a liquid crystal display device. The liquid crystal display device comprises a timing controller and a gate driver. The timing controller is for generating a clock signal with a default frequency. The timing controller comprises a frequency divider, a counter and a switch. The frequency divider is for dividing the clock signal with the default frequency to generate a clock signal with a modulated frequency. The counter is for calculating a turn on time of a backlight module of the LCD device to generate a switching signal. The switch is coupled to the counter, for outputting the clock signal with the default frequency or the clock signal with the modulated frequency according to the switching signal. The gate driver is coupled to the timing controller, for generating a gate signal with a default pulse width according to the clock signal with the default frequency, and generating a gate signal with a modulated pulse width according to the clock signal with the modulated frequency.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 2 is a diagram illustrating the LCD device of the present invention after being turned on before the backlight module is turn on.

FIG. 3 is a diagram illustrating the LCD device of the present invention when the LCD device and the backlight module are both turned on.

DETAILED DESCRIPTION

By increasing a pulse width of the gate signal, a boot margin (i.e. a difference between the high bias voltage Vgh and a low bias voltage Vgl of the gate signal) of a liquid crystal display (LCD) device at low temperature can be increased. Therefore, the objective of the present invention is to modulate the pulse width of the gate signal, for increasing the boot margin of the LCD device at low temperature, so as to allow the LCD device to boot properly at low temperature without requiring an increase in the voltage level (e.g. high bias voltage Vgh) of the gate signal.

Figure 1:
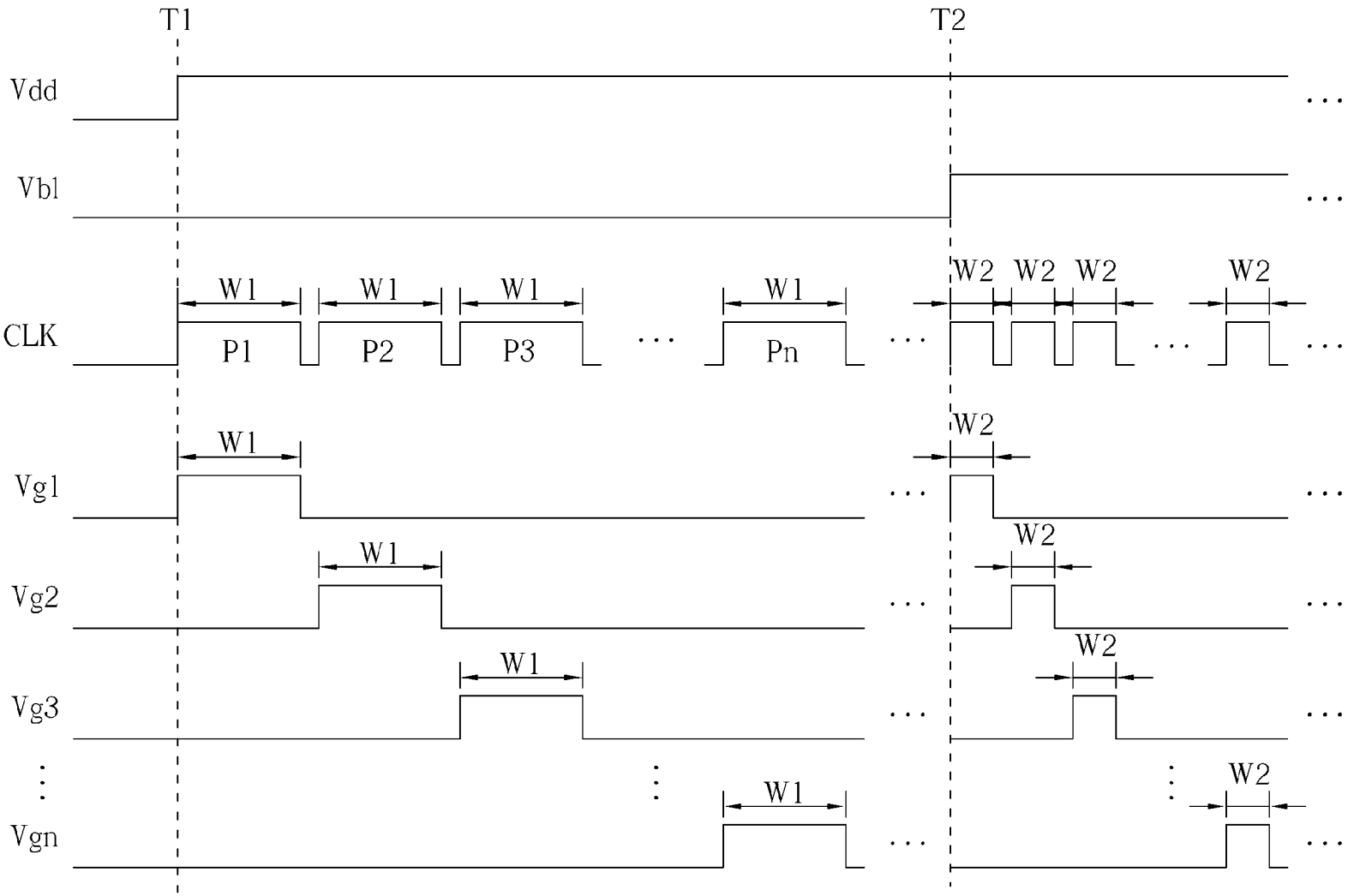
FIG. 1 is a diagram illustrating the method of controlling the gate signals of the LCD device according to an embodiment of the present invention.

Please refer to FIG. 1. FIG. 1 is a diagram illustrating the method of controlling the gate signals of the LCD device according to an embodiment of the present invention. The LCD device of the present invention generates gate signals Vg1, Vg2, Vg3 . . . . Vgn according to a frame frequency CLK (e.g. HSync), where n is a positive integer which corresponds to the number of scan lines of the LCD device. By changing the frame frequency CLK of the LCD device, the LCD device changes the pulse width for each of the gate signals Vg1, Vg2, Vg3 . . . Vgn. For instance, when the frame frequency CLK corresponds to a default pulse width W2, each of the gate signals Vg1, Vg2, Vg3 . . . Vgn possesses the default pulse width W2; when the frame frequency CLK corresponds to a modulated pulse width W1, each of the gate signals Vg1, Vg2, Vg3 . . . Vgn possesses the modulated pulse width W1.

As shown in FIG. 1, at a first instance T1, the LCD device receives a power voltage Vdd of a high voltage level and the LCD device is turned on. When the LCD device is turned on, the LCD device reduces the frame frequency CLK, for changing the frame frequency CLK from the default pulse width W2 to the modulated pulse width W1, so the each of the gate signals Vg1, Vg2, Vg3 . . . Vgn changes from having the default pulse width W2 to the modulated pulse width W1. The LCD device sequentially generates the gate signals Vg1, Vg2, Vg3 . . . Vgn according to the frame frequency CLK of the modulated pulse width W1, so each of the gate signals Vg1, Vg2, Vg3 . . . Vgn possesses the modulated pulse width W1. For instance, when a first pulse P1 of the frame frequency CLK is outputted, the LCD device generates the gate signal Vg1; when a second pulse P2 of the frame frequency CLK is outputted, the LCD device generates the gate signal Vg2; when an nth pulse Pn of the frame frequency CLK is outputted, the LCD device generates the gate signal Vgn and so on.

At a second instance T2, a backlight power voltage Vbl changes from a low voltage level to a high voltage level, for turning on a backlight module of the LCD device. When the backlight module of the LCD device is turned on, the LCD device changes the frame frequency CLK from the modulated pulse width W1 back to the default pulse width W2. The LCD device sequentially generates the gate signals Vg1, Vg2, Vg3 . . . Vgn according to the frame frequency CLK of the default pulse width W2, so each of the gate signals Vg1, Vg2, Vg3 . . . Vgn possesses the default pulse width W2. In the present embodiment, the modulated pulse width W1 is at least double the default pulse width W2.

It is noted that the LCD device decreases the frame frequency CLK for changing the gate signals Vg1, Vg2, Vg3 . . . Vgn from the default pulse width W2 to the modulated pulse width W1 between the first and second instances T1 and T2. Normally, decreasing the frame frequency CLK may cause image flicker, but since the backlight module of the LCD device is not turned on (i.e. voltage level of the backlight power voltage Vbl is low) between the first and second instances T1 and T2, the LCD device does not display images. Also, since the frame frequency CLK is increased back to the default pulse width W2 when the backlight module of the LCD device is turned on at the second instance T2, no flicker results when the LCD device displays images.

Simply put, the present invention generates gate signals with the modulated pulse width W1 according to gate signals with the default pulse width W2. When the LCD device is turned on, gate signals with the modulated pulse width W1 are sequentially outputted, for allowing the LCD device to boot properly. When the backlight module of the LCD device is turned on, the modulated pulse width W1 is switched to the default pulse width W2, and gate signals with the default pulse width W2 are outputted for the LCD device to display images like normal.

Please refer to FIG. 2. FIG. 2 is a diagram illustrating the LCD device 2 of the present invention after being turned on before the backlight module is turn on. The LCD device 2 comprises a timing controller 20 and a gate driver 30. The timing controller 20 is utilized to generate a clock signal with a default frequency fd. The timing controller 20 comprises an oscillator 21, a frequency divider 22, a counter 23 and a switch SW. The oscillator 21 is utilized to generate a clock signal clk with the default frequency fd. The frequency divider 22 is coupled to the oscillator 21, for dividing the clock signal clk with the default frequency fd to generate a clock signal clk with a modulated frequency fm. The counter 23 calculates a turn on time of the backlight module of the LCD device 2, for generating a switching signal Ssw accordingly. The switch SW is coupled to the counter 23, for outputting the clock signal clk with the default frequency fd or outputting the clock signal clk with the modulated frequency fm according to the switching signal Ssw. For instance, when the LCD device 2 is turned on before the backlight module is turned on (i.e. between the first and second instances T1 and T2), the counter 23 outputs the switching signal Ssw of a first voltage level, for controlling the switch SW to output the clock signal clk with the modulated frequency fm; when the LCD device 2 and the backlight module are both turned on (i.e. after the instance T2), the counter 23 outputs the switching signal Ssw of a second voltage level, for controlling the switch SW to output the clock signal clk with the default frequency fd.

The gate driver 30 is coupled to the timing controller 20. The gate driver 30 comprises a plurality of scan lines G1, G2, G3 . . . Gn, where n is a positive integer. The gate driver 30 generates gate signals Vg1, Vg2, Vg3 . . . Vgn with the default pulse width W2 according to the clock signal clk with the default frequency fd, or generates gate signals Vg1, Vg2, Vg3 . . . Vgn with the modulated pulse width W1 according to the clock signal clk with the modulated frequency fm. The default frequency fd is higher than the modulated frequency fm, meaning the modulated pulse width W1 is longer than the default pulse width W2. In the present embodiment, the modulated pulse width W1 is at least double the predetermined modulated width W2.

In the present embodiment, since the backlight module is not turned on, the counter 23 outputs the switching signal Ssw of the first voltage level, for controlling the switch SW to output the clock signal clk with the modulated frequency fm. Hence the gate driver 30 generates the gate signals Vg1, Vg2, Vg3 . . . Vgn with the modulated pulse width W1 according to the modulated frequency fm. After the LCD device 2 is turned on and before the backlight module is turned on (i.e. between the first and second instances T1 and T2), the modulated pulse width W1 of the gate signals Vg1, Vg2, Vg3 . . . Vgn generated by the gate driver 30 is at least double the default pulse width W2, for assisting the LCD device in booting properly.

Figure 3:
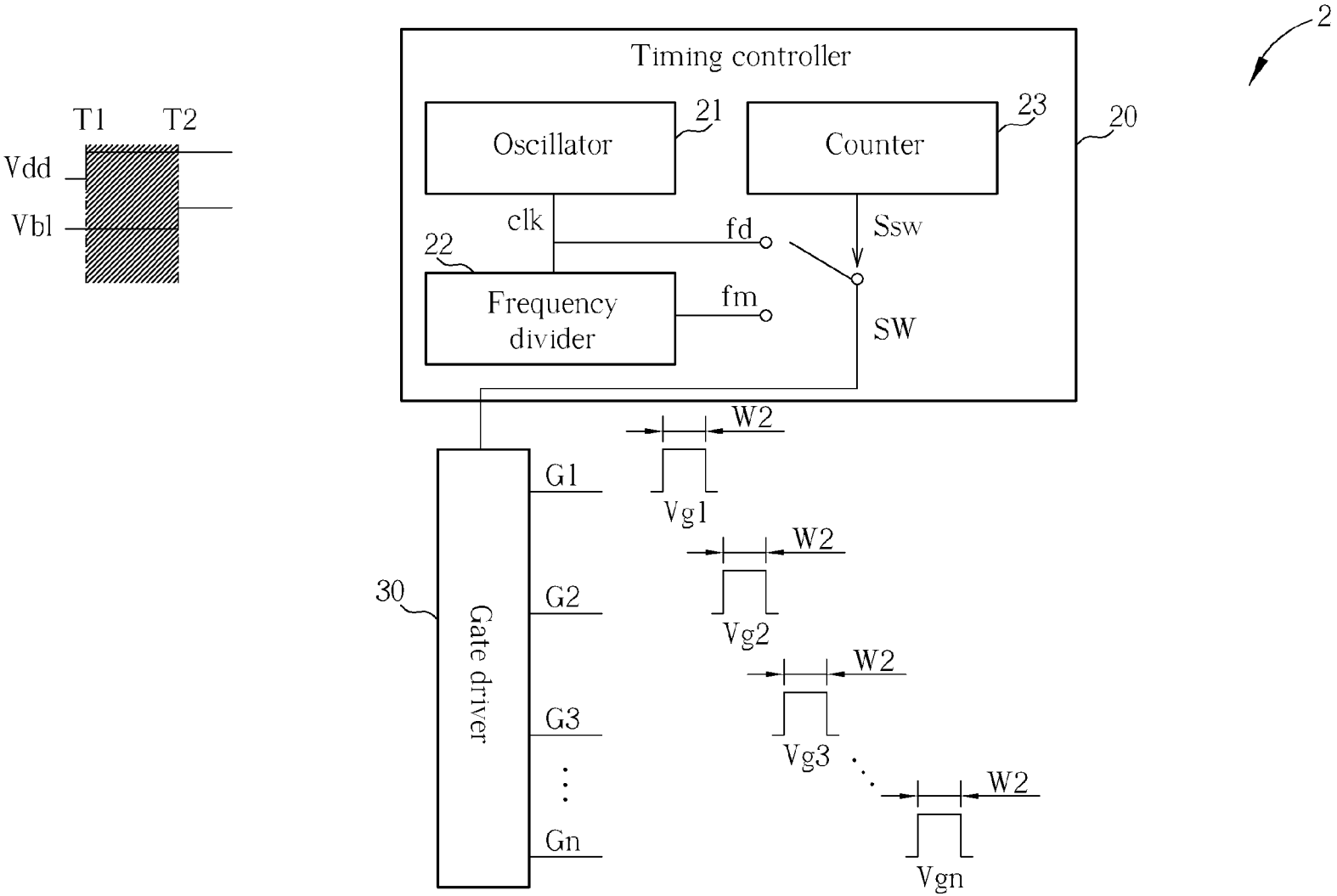

Please refer to FIG. 3. FIG. 3 is a diagram illustrating the LCD device 2 of the present invention when the LCD device 2 and the backlight module are both turned on. The LCD device 2 is similar to the LCD device 2 of FIG. 2. The difference is that since the LCD device and the backlight module are both turned on, the counter 23 switches from outputting the switching signal Ssw of the first voltage level to outputting the switching signal Ssw of the second logic level, for controlling the switch SW to output a clock signal clk with a default frequency fd. The gate driver 30 then switches from outputting the gate signals Vg1, Vg2, Vg3 . . . Vgn with the modulated pulse width W1 to output the gate signals Vg1, Vg2, Vg3 . . . Vgn with the default pulse width W2, so as to control the LCD device to display images with default settings.

In summary, the method for controlling gate signals of the LCD device of the present invention generates the gate signal with the modulated pulse width according to the gate signal with the default pulse width. When the LCD device is turned on, the gate signal with the modulated pulsed width is outputted. When the backlight module of the LCD device is turned on, the gate signal with the modulated pulse width is switched to the gate signal with the default pulse width. The modulated pulse width is at least double the default pulse width. By increasing the pulse width of the gate signal after the LCD device is turned on before turning on the backlight module, the LCD device can boot properly at low temperature without increasing the voltage level of the gate signal. Therefore, the LCD device does not require a thermal sensor and relative components, reducing the cost. Also, since the voltage level of the gate signal is not increased, the power consumption can be reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for controlling gate signals of a liquid crystal display (LCD) device, the method comprising:

generating a gate signal with a modulated pulse width according to a gate signal with a default pulse width;

outputting the gate signal with the modulated pulse width when the LCD device is turned on and a backlight module of the LCD device is off; and switching the gate signal with the modulated pulse width to the gate signal with the default pulse width when a backlight module of the LCD device is turned on;

wherein the modulated pulse width is longer than the default pulse width.

2. The method of claim 1, further comprising:

generating the gate signal with the default pulse width according to a frame frequency of the LCD device.

3. The method of claim 2, wherein generating the gate signal with the modulated pulse width according to the gate signal with the default pulse width comprises:

changing the frame frequency of the LCD device, for converting the gate signal with the default pulse width to the gate signal with the modulated pulse width.

4. The method of claim 3, wherein changing the frame frequency of the LCD device comprises decreasing the frame frequency of the LCD, for the modulated pulse width to be at least double the default pulse width.

5. The method of claim 3, wherein the modulated pulse width is at least double the default pulse width.

6. The method of claim 2, wherein the modulated pulse width is at least double the default pulse width.

7. The method of claim 1, wherein the modulated pulse width is at least double the default pulse width.

8. A liquid crystal display (LCD) device, comprising:

a timing controller, for generating a clock signal with a default frequency, the timing controller comprises:

a frequency divider, for dividing the clock signal with the default frequency to generate a clock signal with a modulated frequency;

a counter, for calculating a turn on time of a backlight module of the LCD device to generate a switching signal; and a switch, coupled to the counter, for outputting the clock signal with the default frequency or the clock signal with the modulated frequency according to the switching signal; and a gate driver, coupled to the timing controller, for generating a gate signal with a default pulse width according to the clock signal with the default frequency, and generating a gate signal with a modulated pulse width according to the clock signal with the modulated frequency when the LCD device is turned on and the backlight module of the LCD device is off;

wherein the modulated pulse width is longer than the default pulse width.

9. The LCD device of claim 8, wherein the switch outputs the clock signal with the modulated frequency according to the switching signal when LCD device is turned on, and outputs the clock signal with the default frequency when the backlight module of the LCD device is turned on.

10. The LCD device of claim 9, wherein the default frequency is higher than the modulated frequency.

11. The LCD device of claim 10, wherein the modulated pulse width is at least double the default pulse width.

12. The LCD device of claim 8, wherein the timing controller further comprises:

an oscillator, coupled to the frequency divider, for generating the clock signal with the default frequency.

13. The LCD device of claim 12, wherein the default frequency is higher than the modulated frequency.

14. The LCD device of claim 13, wherein the modulated pulse width is at least double the default pulse width.

15. The LCD device of claim 8, wherein the default frequency is higher than the modulated frequency.

16. The LCD device of claim 15, wherein the modulated pulse width is at least double the default pulse width.

* * * * *